US006376147B1

(12) United States Patent
Bonsignore et al.

(10) Patent No.: US 6,376,147 B1
(45) Date of Patent: Apr. 23, 2002

(54) METHOD OF PRODUCING LIQUID TONER WITH METALLIC SHEEN

(75) Inventors: Frank J. Bonsignore, Rochester; George A. Gibson, Fairport, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/721,737

(22) Filed: Nov. 27, 2000

(51) Int. Cl.[7] ..... G03G 9/00
(52) U.S. Cl. ..... 430/114
(58) Field of Search ..... 430/114

(56) References Cited

U.S. PATENT DOCUMENTS

| | | | | |
|---|---|---|---|---|
| 3,590,000 A | | 6/1971 | Palermiti et al. | |
| 4,243,694 A | | 1/1981 | Mansukhani | |
| 4,265,990 A | | 5/1981 | Stolka et al. | |
| 4,760,009 A | | 7/1988 | Larson | |
| 4,911,830 A | | 3/1990 | Bromley et al. | |
| 5,223,368 A | | 6/1993 | Ciccarelli et al. | |
| 5,254,427 A | * | 10/1993 | Lane et al. | 430/114 |
| 5,376,494 A | | 12/1994 | Mahabadi et al. | |
| 5,414,498 A | | 5/1995 | Buchan et al. | |
| 5,547,804 A | * | 8/1996 | Nishizawa et al. | 430/114 |
| 5,563,015 A | | 10/1996 | Bonsignore et al. | |
| 5,604,075 A | | 2/1997 | Larson et al. | |
| 5,643,707 A | | 7/1997 | Larson et al. | |
| 5,672,456 A | | 9/1997 | Chamberlain et al. | |
| 5,688,624 A | | 11/1997 | Chamberlain et al. | |
| 5,783,349 A | | 7/1998 | Spiewak et al. | |
| 5,866,292 A | | 2/1999 | Chamberlain et al. | |
| 6,221,551 B1 | * | 4/2001 | Bonsignore et al. | 430/114 |

* cited by examiner

*Primary Examiner*—Mark Chapman
(74) *Attorney, Agent, or Firm*—Oliff & Berridge, PLC; Eugene O. Palazzo

(57) ABSTRACT

A liquid toner includes a carrier liquid, and toner particles including a thermoplastic resin and a metallic colorant dispersed in said thermoplastic resin, the toner particles being dispersed in the carrier liquid. The liquid toner enables formation of printed images having a metallic sheen using a liquid toner imaging process.

23 Claims, No Drawings

METHOD OF PRODUCING LIQUID TONER WITH METALLIC SHEEN

BACKGROUND OF THE INVENTION

1. Field of Invention

This invention relates to a method for producing a liquid toner or developer composition, more particularly a liquid toner or developer composition comprising metallic particles. The invention also relates to liquid toner or developer compositions made by such a process, and the use of such liquid toner or developer compositions in electrostatographic imaging processes.

2. Description of Related Art

A latent electrostatic image can be developed with toner particles dispersed in an insulating non-polar liquid. Such dispersed materials are known as liquid toners or liquid developers. A latent electrostatic image may be produced by providing a photoconductive layer with a uniform electrostatic charge and subsequently discharging the electrostatic charge by exposing it to a beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a non-polar liquid. The image may then be transferred to a substrate or receiver sheet, such as paper or transparency.

Insufficient particle charge can result in poor image quality and also can result in poor transfer of the liquid developer or solids thereof to paper or other final substrates. Poor transfer can, for example, result in poor solid area coverage if, for example, insufficient toner is transferred to the final substrate, and can also cause image defects such as smears and hollowed fine features. Conversely, overcharging the toner particles can result in low reflective optical density images or poor color richness or chroma since only a few very highly charged particles can discharge all the charge on the dielectric receptor, causing too little toner to be deposited.

Useful liquid toners comprise thermoplastic resin toner particles and a dispersant non-polar liquid. Generally, a suitable colorant, such as a dye or pigment, is present in the toner particles. The colored toner particles are dispersed in a non-polar liquid that generally has a high volume resistivity, such as in excess of $10^9$ Ω-cm, a low dielectric constant, for example below 3.0, and a high vapor pressure. Generally, the toner particles have an average particle size (by area) or diameter of less than 7 microns as measured with a Horiba CAPA 700 Particle Sizer.

Various methods are known in the art for producing liquid toners and developers. The conventional process for producing such liquid toners involves a two-step batch process, wherein the first step involves a hot step where the non-polar liquid and molten resin are melt mixed with pigment and other additives, and the second step involves a cold step where the molten contents are cooled to cause solidification and formation of particles in the non-polar liquid.

For example, one process of making such liquid toners is described in U.S. Pat. No. 4,760,009, the entire disclosure of which is incorporated herein by reference, which describes such a two step process. According to the patent, the process comprises a first step of dispersing a thermoplastic resin, a non-polar liquid having a Kauri-butanol value of less than 30, and optionally a colorant at an elevated temperature in a vessel by means of moving particulate media. The temperature in the vessel is maintained at a temperature sufficient to plasticize and liquefy the resin and below that at which the non-polar liquid boils and the resin and/or colorant decomposes. In a second step, the dispersion is cooled to permit precipitation of the resin out of the dispersant. The particulate media is maintained in continuous movement during and subsequent to the cooling. Both steps are carried out in a suitable vessel, such as an attritor, a heated ball mill, or a heated vibratory mill, equipped with particulate media for dispersing and grinding. The result is described as toner particles having an average by area particle size of less than 10 μm and a plurality of fibers. Following the second step, the dispersion of toner particles can be separated from the particulate media.

The patent describes that useful thermoplastic resins or polymers that are able to form fibers and that can be used in the production method include ethylene vinyl acetate copolymers, copolymers of ethylene and an α,β-ethylenically unsaturated acid, copolymers of ethylene/acrylic or methacrylic acid/alkyl (C1 to C5) ester of methacrylic or acrylic acid, polyethylene, isotactic polypropylene (crystalline), ethylene ethyl acrylate series, and ethylene vinyl acetate resins.

Other methods for forming liquid toners, which are generally variants of the above process, are described, for example, in U.S. Pat. Nos. 5,604,075, 5,688,624, 5,783,349 and 5,866,292, the entire disclosures of which are incorporated herein by reference. For example, U.S. Pat. No. 5,604,075 describes a process for the preparation of liquid developers with reduced fines, which comprises heating a liquid developer comprised of thermoplastic resin, pigment, charge adjuvant, liquid hydrocarbon, and optional charge director. The heating is accomplished at about 5° C. below the melting point of the thermoplastic resin, which heating enables the fines comprised of the developer components, and of a size diameter of from about 0.1 to about 0.4 micron, to be reduced.

SUMMARY OF THE INVENTION

Despite the various liquid toners and developers that are available, and the known methods for making such liquid toners and developers, there remains a need in the art for improved liquid toners and developers that provide high print quality, and for methods for producing such liquid toners and developers. This need is particularly evident for liquid toners and developers having a broader spectrum of available custom colors, including metallic colors.

In particular, there is a large market for metallic-colored inks and printing. However, it has been very difficult in the past to provide liquid toners and developers that can provide high quality prints with metallic colors. Accordingly, the present invention provides new and improved liquid toners and developers, that include metallic colorants, and which provide high quality printed images.

More particularly, in embodiments, the present invention provides a liquid toner comprising:

a carrier liquid, and toner particles including a thermoplastic resin and a metallic colorant dispersed in said thermoplastic resin, said toner particles being dispersed in said carrier liquid.

In other embodiments, the present invention provides methods for producing such a liquid toner composition, as well as methods for developing an image using such a liquid toner composition.

DETAILED DESCRIPTION OF EXEMPLARY EMBODIMENTS

According to the present invention, a liquid toner or developer composition is provided that includes any of a wide variety of metallic colorants. These liquid toner and developer compositions provide high quality printed images, while exhibiting good properties in terms of image development, transfer of the developed image to a substrate such as paper, and fusing of the image to the substrate.

The liquid toner and developer compositions can be made according to any of the various known techniques, including those in the above-described patents, as will be apparent to those skilled in the art. For example, the liquid toner and developer compositions can be made by the conventional processes including the steps of (1) preparing a colorant/resin mixture, and (2) cold grinding the colorant/resin mixture with addition of a suitable non-polar liquid, to prepare the final liquid toner or developer composition. In embodiments of the present invention, the liquid toner can be dry ground between the above steps (1) and (2) to reduce the particle size of the colorant/resin mixture prior to the cold grinding step, if desired. In other embodiments of the present invention, the liquid toner can be prepared by a single step process whereby the colorant, resin, carrier liquid and other optional additives are mixed together and formed into desired sized particles.

Although the following discussion is based on the conventional two step process, the present invention is not limited thereto. Rather, the various components can be suitable combined according to any desired process.

In the first step of the liquid toner formation process, a thorough melt-mix and dispersion of pigment and/or other additives in the resin material is formed. In embodiments, the pigment can be in any suitable form, including conventional pigments and pigments predispersed in a suitable medium, described in more detail below. This melt-mixing can be performed using any suitable mixing apparatus, including but not limited to an attritor, a heated ball mill, or a heated vibratory mill, equipped with particulate media for dispersing and grinding, or even an extruder or similar processing equipment, which provides a homogeneous or uniform dispersion of the colorant and/or other additives in the resin. In producing the homogeneous dispersion, the desired resin material is melt-mixed with any desired colorant and/or other additives that are to be incorporated into the liquid toner.

The first (melt-mixing) step can be conducted in any suitable processing equipment that will provide the necessary homogeneous dispersion of the colorant and/or other additives in the resin. Thus, although an extruder is preferred, particularly where polyester resins are to be used, other suitable equipment can include a Banbury mill, a 2 roll mill, or a sigma blade mixer. Suitable operating parameters for such mixing equipment can readily be determined by one of ordinary skill in the art based on the various components to be melt-mixed. In the case of an extruder, suitable mixing is obtained, for example, at a mixing temperature of from about 104 to 122° C. (220 to 251 ° F.), melt Oust before the material exits the die) and die temperatures of about 115–117° C. (240–243° F.), and screw rpm of about 15 rpm with an extrusion pressure of from about 270 to 490 psi. Of course, these are exemplary parameters only, and are not limiting on the present invention.

Suitable additives that can be melt-mixed with the resin material and incorporated into the liquid toner include, but are not limited to, colorants, adjuvants and charge control additives. Other suitable additives, known to those of ordinary skill in the art, can also be incorporated into the liquid toner in known amounts for their known purposes.

According to the present invention, the liquid toner or developer includes at least one metallic colorant. The metallic colorant is preferably of a size, type, and shape that it provides, when mixed into the toner particles, a metallic sheen to a resultant printed image.

Suitable metallic colorants include, but are not limited to, particles of a desired metal to provide the desired color. In embodiments, the metallic colorants can include, but are not limited to, colorants that include, in whole or in part, single or multiple (i.e., mixtures of) elemental metals, single or multiple metal alloys; mixtures of one or more elemental metals and metal alloys, metal compounds such as metal oxides, metal complexes, and the like, or mixtures of one or more of the foregoing, so long as the colorant exhibits the desired metallic appearance effect. However, in embodiments, elemental metals and metal alloys are preferred in terms of their color strength. For example, the colorant can include particles of aluminum, silver, gold, copper, iron, steel such as stainless steel, titanium, brass, bronze, mixtures thereof, and the like. Suitable examples include, but are not limited to, STAPA OFFSET 3000, Rich XM-40, and Pale Gold (each available from Obron-Atlantic, Painesville, Ohio). When metallic particles are used, they are preferably of a suitable particle size to permit dispersion in the liquid toner, while providing desired toner particle sizes. Thus, for example, it is preferred that the metallic particles have an average particle size of less than about 10 microns, preferably from about 1 to about 10 microns, more preferably less than about 9 or about 8 microns or from about 2 or about 3 to about 8 or about 9 microns. However, other sizes and types of particles can be used, if desired.

According to embodiments of the present invention, the metallic colorant can be any suitable shape, including but not limited to spherical particles, flakes, slivers, rods, and the like.

In embodiments of the present invention, the metallic colorant can be included in the toner composition in any suitable or desirable amount, to provide desired toner properties as well as metallic appearance strength. Thus, for example, the metallic colorant can be included in the toner particles in an amount of from about 5 percent to about 50 percent, more preferably from about 5 or about 10 percent to about 25 or about 30 percent, although amounts outside these ranges can be used, if desired.

If desired, the metallic particles used as the metallic colorant can also include a surface coating of an insulating material. This may be desirable, for example, if the metallic colorant would otherwise affect the charging properties of the toner, or where a significant amount of the metallic colorant is otherwise exposed at the surface of the toner particles. When an insulating coating is used, any suitable material can be employed. Preferably, such an insulating coating should be thin with respect to the size of the metallic colorant, so that the color strength and appearance is not adversely affected.

In addition to the metallic colorants, the liquid toner or developer of the present invention can also include, if desired, one or more conventional colorants. The additional colorants can be either incorporated into the same toner particles as the metallic colorant, or they can be incorporated into separate toner particles. Thus, for example, the additional colorant can be incorporated into the same toner particles as the metallic colorant so that each toner particle includes both a metallic colorant and a conventional colorant. Alternatively, the separate colorants can be incorporated into separate toner particles from the metallic colorants, and the resultant toner particles having different colorants can be blended together into the same ink composition. Thus, for example, the liquid toner or developer can include one or more additional colorants, such as process colors (cyan, magenta, yellow, red, blue black and the like) and/or fluorescent colors. The additional colorants can provide metallic colored liquid toners and developers, to provide an even broader possible color gamut.

Suitable colorants for use in embodiments of the present invention can include any of the various colorants, such as pigments or dyes and mixtures thereof. Such colorants are preferably present in the liquid toner to render the resultant developed latent image visible at a desired color strength. The colorant, preferably a pigment, may be present in the liquid toner in an effective amount of, for example, from about 0.1 to about 60 percent, and preferably from about 10 to about 50 percent, and in embodiments more preferably from about 20 to about 40 percent by weight, based on the total weight of solids contained in the liquid toner. Even more preferably, the colorant concentration is from about 20 to about 30 percent by weight, based on the total weight of solids contained in the liquid toner. The amount of colorant used may vary depending on the use of the liquid toner.

Examples of suitable pigments that may be used according to the present invention include, but are not limited to, carbon blacks available from, for example, Cabot Corporation, such as MONARCH 1300®, REGAL 330® and BLACK PEARLS®, and pigments such as FANAL PFNK™, PV FAST BLUE™, SUNFAST BLUE 15:3, pigments as illustrated in U.S. Pat. Nos. 5,223,368 and 5,254,427, the entire disclosures of which are incorporated herein by reference, other known pigments, mixtures thereof, and the like.

Illustrative examples of magenta pigments include 2,9-dimethyl-substituted quinacridone and anthraquinone, identified in the Color Index as CI 60710, CI Dispersed Red 15, CI Solvent Red 19, and the like. Illustrative examples of suitable cyan pigments include copper tetra-4-(octadecyl sulfonamido) phthalocyanine, X-copper phthalocyanine pigment, listed in the Color Index as CI 74160, CI Pigment Blue, and Anthradanthrene Blue, identified in the Color Index as CI 69810, Special Blue Xo2137, and the like. Illustrative examples of yellow pigments that can be selected include diarylide yellow 3,3-dichlorobenzidene acetoacetanilides, a monoazo pigment identified in the Color Index as Cl 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Additional examples of pigments include Normandy Magenta RD-2400 (Paul Uhlich), Sunsperse Quindo Magenta QHD 6040 (Sun Chemicals), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Other specific suitable pigments that may be used in the present toners and developers include those set forth below:

| Pigment Brand Name | Manufacturer | Color |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chem. | Yellow 14 |
| L75-1331 Yellow | Sun Chem. | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| L75-2337 Yellow | Sun Chem. | Yellow 83 |
| Cromophthal ® Yellow 3G | Ciba Geigy | Yellow 93 |
| Cromophthal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophthal ® Yellow 8G | Ciba-Geigy | Yellow 128 |
| Irgazine ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| Hostaperm ® Orange GR | Hoechst | Orange 43 |
| Paliogen ® Orange | BASF | Orange 51 |
| lrgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue TBD 7010 | BASF | Blue: 3 |
| Heliogen ® Blue K 7090 | BASF | Blue 15:3 |
| Heliogen ® Blue L 7101F | BASF | Blue 15:4 |
| Heliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet | Ciba-Geigy | Violet 19 |
| Monastral ® Red | Ciba-Geigy | Violet 19 |
| Quindo ® Red 6700 | Mobay | Violet 19 |
| Quindo ® Red 6713 | Mobay | Violet 19 |
| Indofast ® Violet | Mobay | Violet 19 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L | Cabot | Black, CI 77266 |
| Uhlich ® BK 8200 | Paul Uhlich | Black |

Other pigments can also be selected.

Various dyes, including organic dyes, can also be used as the colorant material to color the resin particles. That is, the resin may be treated with any suitable organic dye to impart color to it. When used, the organic dye is preferably dispersible at the molecular level in the resin to provide a molecular dispersion and ensure good distribution, since it would otherwise tend to aggregate and give poor color intensity as well as broadened spectral characteristics.

Furthermore, the organic dye should be insoluble in the carrier liquid so that once it is imbibed into the resin, it will not diffuse out into the dispersion medium. In addition, insolubility in the dispersion medium ensures that the background deposits will be minimized, since as noted above, the entire imaging surface may be contacted with the liquid developer during development of the electrostatic latent image and the dye cannot deposit on the background areas of the imaging surface if the dye is insoluble in the liquid phase. Moreover, it is preferred that the dye be water insoluble to ensure permanence of the developed image and to avoid dissolving subsequent to development should the image come into contact with water as may frequently be the case in an office environment with coffee, tea and the like.

When dyes are used in the ink compositions of the present invention, any suitable commercially available dye may be used to impart the desired color characteristics to the ink. In embodiments, preferred dyes are the anionic dyes. Specific examples of anionic dyes include Bemacid Red 2BMN, Pontamine Brilliant Bond Blue A, BASF X-34, Pontamine, Food Black 2, Carodirect Turquoise FBL Supra Conc. (Direct Blue 199, Carolina Color and Chemical), Special Fast Turquoise 8GL Liquid (Direct Blue 86, Mobay Chemical), Intrabond Liquid Turquoise GLL (Direct Blue 86, Crompton and Knowles), Cibracron Brilliant Red 38-A (Reactive Red 4, Aldrich Chemical), Drimarene Brilliant Red X-2B (Reactive Red 56, Pylam, Inc.), Levafix Brilliant Red E-4B (Mobay Chemical), Levafix Brilliant Red E-6BA (Mobay Chemical), Pylam Certified D&C Red #28 (Acid Red 92, Pylam), Direct Brill Pink B Ground Crude (Crompton & Knowles), Cartasol Yellow GTF Presscake (Sandoz, Inc.), Tartrazine Extra Conc. (FD&C Yellow #5, Acid Yellow 23, Sandoz), Carodirect Yellow RL (Direct Yellow 86, Carolina Color and Chemical), Cartasol Yellow GTF Liquid Special 110 (Sandoz, Inc.), D&C Yellow #10 (Acid Yellow 3, Tricon), Yellow Shade 16948 (Tricon), Basacid Black X34 (BASF), Carta Black 2GT (Sandoz, Inc.), Neozapon Red 492 (BASF), Orasol Red G (Ciba-Geigy), Direct Brilliant Pink B (Crompton-Knolls), Aizen Spilon Red C-BH (Hodagaya Chemical Company), Kayanol Red 3BL (Nippon Kayaku Company), Levanol Brilliant Red 3BW (Mobay Chemical Company), Levaderm Lemon Yellow (Mobay Chemical Company), Spirit Fast Yellow 3G, Aizen Spilon Yellow C-GNH (Hodagaya Chemical Company), Sirius Supra Yellow GD 167, Cartasol Brilliant Yellow 4GF (Sandoz), Pergasol Yellow CGP (Ciba-Geigy), Orasol Black RL (Ciba-Geigy), Orasol Black RLP (Ciba-Geigy), Savinyl Black RLS (Sandoz), Dermacarbon 2GT (Sandoz), Pyrazol Black BG (ICI), Morfast Black Conc A (Morton-Thiokol), Diazol Black RN Quad (ICI), Orasol Blue GN (Ciba-Geigy), Savinyl Blue GLS (Sandoz), Luxol Blue MBSN (Morton-Thiokol), Sevron Blue 5GMF (ICI), and Basacid Blue 750 (BASF); Levafix Brilliant Yellow E-GA, Levafix Yellow E2RA, Levafix Black EB, Levafix Black E-2G, Levafix Black P-36A, Levafix Black PN-L, Levafix Brilliant Red E6BA, and Levafix Brilliant Blue EFFA, all available from Bayer; Procion Turquoise PA, Procion Turquoise HA, Procion Turquoise Ho5G, Procion Turquoise H-7G, Procion Red MX-5B, Procion Red H8B (Reactive Red 31), Procion Red MX 8B GNS, Procion Red G, Procion Yellow MX-8G, Procion Black H-EXL, Procion Black P-N, Procion Blue MX-R, Procion Blue MX-4GD, Procion Blue MX-G, and Procion Blue MX-2GN, all available from ICI; Cibacron Red F-B, Cibacron Black BG, Lanasol Black B, Lanasol Red 5B, Lanasol Red B, and Lanasol Yellow 46, all available from Ciba-Geigy; Baslien Black P-BR, Baslien Yellow EG, Baslien Brilliant Yellow P-3GN, Baslien Yellow M-6GD, Baslien Brilliant Red P-3B, Baslien Scarlet E-2G, Baslien Red E-B, Baslien Red E-7B, Baslien Red M-5B, Baslien Blue E-R, Baslien Brilliant Blue P-3R, Baslien Black P-BR, Baslien Turquoise Blue P-GR, Baslien Turquoise M-2G, Baslien Turquoise E-G, and Baslien Green E-6B, all available from BASF; Sumifix Turquoise Blue G, Sumifix Turquoise Blue H-GF, Sumifix Black B, Surnifix Black H-BG, Sunifix Yellow 2GC, Sumifix Supra Scarlet 2GF, and Sumifix Brilliant Red 5BF, all available from Sumitomo Chemical Company; Intracron Yellow C-8G, Intracron Red C-8B, Intracron Turquoise Blue GE, Intracron Turquoise HA, and Intracron Black RL, all available from Crompton and Knowles, Dyes and Chemicals Division; mixtures thereof, and the like.

Dyes that are invisible to the naked eye but detectable when exposed to radiation outside the visible wavelength range (such as ultraviolet or infrared radiation), such as dansyl-lysine, N-(2-aminoethyl)-4-amino-3,6-disulfo-1,8-dinaphthalimide dipotassium salt, N-(2-aminopentyl)-4-amino-3,6-disulfo-1,8-dinaphthalimide dipotassium salt, Cascade Blue ethylenediamine trisodium salt (available from Molecular Proes, Inc.), Cascade Blue cadaverine trisodium salt (available from Molecular Proes, Inc.), bisdiazinyl derivatives of 4,4'-diaminostilbene-2,2'-disulfonic acid, amide derivatives of 4,4'-diaminostilbene-2,2'-disulfonic acid, phenylurea derivatives of 4,4'-disubstituted stilbene-2,2'-disulfonic acid, mono- or di-naphthyltriazole derivatives of 4,4'-disubstituted stilbene disulfonic acid, derivatives of benzithiazole, derivatives of benzoxazole, derivatives of benzimidazole, derivatives of coumarin, derivatives of pyrazolines containing sulfonic acid groups, 4,4'-bis(triazin-2-ylamino)stilbene-2,2'-disulfonic acids, 2-(stilben-4-yl)naphthotriazoles, 2-(4-phenylstilben-4-yl) benzoxazoles, 4,4-bis(triazo-2-yl)stilbene-2,2'-disulfonic acids, 1,4-bis(styryl)biphenyls, 1,3-diphenyl-2-pyrazolines, bis(benzazol-2-yl) derivatives, 3-phenyl-7-(triazin-2-yl) coumarins, carbostyrils, naphthalimides, 3,7-diaminodibenzothiophen-2,8-disulfonic acid-5,5-dioxide, other commercially available materials, such as C.I. Fluorescent Brightener No. 28 (C.I. 40622), the fluorescent series Leucophor B-302, BMB (C.I. 290), BCR, BS, and the like (available from Leucophor), and the like, are also suitable.

In addition, the liquid toners and developers of the present invention can include one or more fluorescent colorants, which can be pigments, dyes, or a mixture of pigments and dyes. For example, suitable fluorescent pigment concentrates are disclosed in U.S. Pat. No. 4,911,830, the entire disclosure of which is incorporated herein by reference, and suitable fluorescent colorants are disclosed in U.S. Pat. No. 4,243,694, the entire disclosure of which is incorporated herein by reference. Suitable inorganic fluorescent pigments can be prepared, for example, by adding trace amounts of activating agents such as copper, silver and manganese to high purity sulfides of heavy metals or alkaline earth metals such as zinc sulfide, which are used as raw materials, and calcining them at a high temperature. Suitable organic fluorescent pigments can be prepared, for example, by dissolving fluorescent dyes in the vehicles of synthetic resins or ones prepared by dyeing the dispersed matters of fine resin particles obtained by emulsion polymerization or suspension polymerization with fluorescent dyes. The synthetic resins can include, but are not limited to, vinyl chloride resins, alkid resins and acrylic resins, and the fluorescent dyes include, but are not limited to, C.I. acid yellow 7, C.I. basic red I and the like.

Although not limited thereto, suitable fluorescent dyes include, but are not limited to, those belonging to the dye families known as rhodamines, fluoresciens, coumarins, napthalimides, benzoxanthenes, acridines, azos, and the like. Suitable fluorescent dyes include, for example, Basic Yellow 40, Basic Red 1, Basic Violet 11, Basic Violet 10, Basic Violet 16, Acid Yellow 73, Acid Yellow 184, Acid Red 50, Acid Red 52, Solvent Yellow 44, Solvent Yellow 131, Solvent Yellow 85, Solvent Yellow 135, solvent Yellow 43, Solvent Yellow 160 and Fluorescent Brightner 61. Suitable fluorescent pigments include, but are not limited to, those available from Day-Glo Color Corp. of Cleveland, Ohio, such as aurora pink T-11 and GT-11, neon red T-12, rocket red T-13 or GT-13, fire orange T-14 or GT-14N, blaze orange T-15 or GT-15N, arc yellow T-16, saturn yellow T-17N, corona magenta GT-21 and GT-17N, and the like.

According to the present invention, because liquid toners typically have a final colorant content of 20 percent by weight or more, it is particularly advantageous to supply the colorant, particularly pigment, in the form of it being predispersed in a suitable carrier such as a resin. Alternatively, the metallic colorant can be provided in the form of a paste, particularly where the metallic particles themselves (such as aluminum) may be considered a health or safety hazard. When the metallic colorant is provided in such forms, which are usually of a high weight percent such as 40, 50, 65 percent or more colorant, the colorant is generally let down to the desired loading level for the liquid toner or developer composition.

Of course, the colorant need not necessarily be provided in the form of a predispersed colorant or paste form. Rather, any suitable colorant material may be used, so long as the colorant concentration in the final liquid toner can be provided to obtain desired print quality, and so long as the colorant material is not incompatible with the extruder mixing operation.

Another optional additional component of the electrostatic liquid developer is an adjuvant, which can include, but is not limited to, polyhydroxy compounds, aminoalcohol, polybutylene succinimides, metallic soaps, aromatic hydrocarbons having a kauri-butanol value of greater than 30, mixtures thereof, and the like. These adjuvants are generally used in an amount of 1 to 1000 mg/g, preferably 1 to 200 mg/g of developer solids. Examples of the various above-described adjuvants include, but are not limited to:

A) polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glyceroltri-12 hydroxystearate, ethylene glycol monohydroxystearate, propylene glycerol monohydroxy-stearate;

B) aminoalcohol compounds: triisopropanolamine, triethanolamine, ethanolamine, 3-amino-i-propanol, o-aminophenol, 5-amino-1-pentanol, tetra(2-hydroxyethyl)ethylenediamine;

C) polybutylene/succinimide: OLOA™-1200 sold by Chevron Corp.; Amoco 575 having a number average molecular weight of about 600 (vapor pressure osmometry) made by reacting maleic anhydride which in turn is reacted with a polyamine (Amoco 575 is 40 to 45% surfactant, 364 aromatic hydrocarbon, and the remainder oil);

D) metallic soaps: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium, cobalt, manganese, lead and zinc naphthenates; calcium, cobalt, manganese, lead and zinc resinates;

E) aromatic hydrocarbons: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of C9 and C 10 alkyl-substituted benzenes manufactured by Exxon Corp; and F) aluminum di-tertiary butyl salicylate (ALOHAS) and similar compounds.

Various other additives, which are known in the art, can also be incorporated into the developers of the present invention. Such additives can be incorporated either into the resin/colorant mixtures, i.e., mixed directly into the toner or developer particles, or can be added as surface agents on the surface of the resin/colorant particles once formed.

When the above additives are to be incorporated into the liquid toner, it is preferred that they be added with the resin material and preferably in the first mixing step. This permits the additives to be dispersed directly and uniformly into the resin particles. In embodiments of the present invention, it is particularly preferred that at least the colorant be added with the resin material in the first mixing step, and it is particularly preferred that all of the additives, except for the non-polar liquid, be added with the resin material in the first mixing step. However, in other embodiments, some of the additives can be added at earlier or subsequent stages of the toner preparation process.

According to the present invention, any suitable resin can be used as the resin material, including polyester resins and non-polyester resins. Suitable examples of such polyester resins include, but are not limited to, polyester, particularly the SPAR polyesters, which are commercially available, and are described in U.S. Pat. No. 3,590,000, the entire disclosure of which is incorporated herein by reference; reactive extruded polyesters, with a gel amount of from about 10 to about 40 percent by weight, or other gel amounts, or substantially no gel, as described in U.S. Pat. No. 5,376,494, the entire disclosure of which is incorporated herein by reference; mixtures thereof and the like. Mixtures of polyester with one or more other resins can also be used. Furthermore, the polyester can be present either as a polyester homopolymer, or other resin species may be present with the polyester in the form of a copolymer, terpolymer, or the like, in block form, graft form, or the like.

Typical examples of other suitable thermoplastic toner resins include, but are not limited to, ethylene vinyl acetate (EVA) copolymers (such as the NUCREL™ and ELVAX™ series of resins, available from E.I. DuPont de Nemours and Company, Wilmington, Del.); copolymers of ethylene and an $\alpha,\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series, such as available as BAKELITE™ DPD 6169, DPDA 6182 NATURAL™ (available from Union Carbide Corporation, Stamford, Conn.); ethylene vinyl acetate resins like DQDA 6832 Natural 7 (available from Union Carbide Corporation); SURLYN™ ionomer resin (available from E.I. DuPont de Nemours and Company); or blends thereof; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE™ acrylic resins (available from E.I. DuPont de Nemours and Company); or blends thereof.

According to the present invention, the resin material is present in any effective amount to provide a suitable liquid toner. Generally, the resin material can be present in an amount of from about 99.9 percent to about 40 percent by weight, and preferably from about 80 percent to about 50 percent by weight, of total solids in the liquid toner composition. However, amounts outside of these ranges may be acceptable, in embodiments.

Following mixing in the first mixing step, the mixed product can, if desired, be ground to provide a material having a smaller particle size prior to being processed in the cold grinding step. Where such intermediate grinding is conducted, it is preferred that the grinding be dry grinding, i.e., in the absence of any or significant quantities of solvent and/or other liquids. Such grinding can be performed, for example, in a Fitz mill or other suitable grinding apparatus. Such grinding can be conducted to reduce the particle size of the colorant/resin composition to a smaller particle size. For example, grinding to a particle size of from about 100 to about 2,000 $\mu$m, preferably 200 to about 1,500 $\mu$m, or more preferably from about 500 to about 1,000 $\mu$m, provides acceptable results.

Where an intermediate pre-grinding step is used and additives are to be added to the resin/colorant mixture between the first mixing step and the subsequent cold grinding step, such additives can be added at any appropriate time with respect to the pre-grinding step. That is, if desired, such additives can be added to the resin/colorant mixture after completion of the first mixing step, but prior to the pre-grinding operation. This procedure allows the additives to be mixed and ground with the resin/colorant mixture. Alternatively, the additive can be added subsequent to the pre-grinding operation but prior to the cold grinding operation. This procedure is particularly suited for situations where the additive is in either a liquid solution or dispersion form. Of course, if desired, the additive can also be fed into the resin/colorant mixture during the pre-grinding operation, if desired.

The mixed material, optionally further ground to a smaller particle size, is next generally processed in a cold grinding operation in an attritor or similar processing equipment. This cold grinding stage is generally comparable to the cold grinding operation performed in the conventional liquid toner preparation process.

The material is mixed in the mixing apparatus with a sufficient quantity of a non-polar liquid to arrive at a suitable concentration for the grinding operation, or at the desired solids content loading of the liquid toner.

Examples of suitable non-polar liquid carriers that can be used to form the liquid toners or developers according to embodiments of the present invention generally include any of the various known or after-developed liquid carriers that provide desired properties to the liquid toner. For example, suitable non-polar liquids include, but are not limited to, those having an effective viscosity of, for example, from about 0.5 to about 500 centipoise at 25° C., and preferably from about 1 to about 20 centipoise at 25° C., and an electrical volume resistivity equal to or greater than $1\times10^9$ Ω-cm, preferably greater than or equal to $5\times10^9$ Ω-cm, and more preferably greater than or equal to $5\times10^{13}$ Ω-cm. The liquid selected also preferably has a dielectric constant below 3.0. Moreover, the vapor pressure at 25° C. is preferably less than 10 Torr in embodiments.

Preferably, the non-polar liquid selected for use according to the present invention is a branched chain aliphatic hydrocarbon, although straight-chain hydrocarbons can also suitably be used. A non-polar liquid of the ISOPAR™ series (manufactured by the Exxon Corporation) may also be used for the liquid toners and developers of the present invention. These hydrocarbon liquids are considered narrow portions of isoparaffinic hydrocarbon fractions with extremely high levels of purity. For example, the boiling range of ISOPAR G™ is between about 157° C. and about 176° C.; ISOPAR H™ is between about 176° C. and about 191OC; ISOPAR K™ is between about 177° C. and about 197° C.; ISOPAR L™ is between about 188° C. and about 206° C.; ISOPAR M™ is between about 207° C. and about 254° C.; and ISOPAR V™ is between about 254.4° C. and about 329.4° C. ISOPAR L™ has a mid-boiling point of approximately 194° C. ISOPAR M™ has an auto ignition temperature of 338° C. ISOPAR G™ has a flash point of 40° C. as determined by the tag closed cup method; ISOPAR H™ has a flash point of 53° C. as determined by the ASTM D-56 method; ISOPAR L™ has a flash point of 61° C. as determined by the ASTM D-56 method; and ISOPAR M™ has a flash point of 80° C. as determined by the ASTM D-56 method. In embodiments of the present invention, ISOPAR L™ is the preferred liquid vehicle for the liquid toner and developer compositions.

While the ISOPAR™ series liquids can be the preferred non-polar liquids for use as the dispersant in the liquid toners and developers of the present invention, the essential characteristics of viscosity and resistivity may be satisfied with other suitable liquids. Specifically, the NORPAR™ series of liquids, which are substantially pure compositions of n-paraffins available from Exxon Corporation, the SOLTROL™ series of liquids available from the Phillips Petroleum Company, and the SHELLSOL™ series of liquids available from the Shell Oil Company can also be selected and used in embodiments of the present invention.

The amount of the liquid employed in the liquid toners and developers of the present invention is, for example, from about 85 to about 99.9 percent, and preferably from about 90 to about 99 percent by weight of the total toner or developer dispersion. However, any other effective amount of liquid may be selected, depending, for example, on the desired final use of the composition. The total solids content of the toner or developer, which include resin, colorant and other additives such as charge control additives, in embodiments is, for example, 0.1 to 15 percent by weight, preferably 0.3 to 10 percent, and more preferably, 0.5 to 10 percent by weight.

Various charge control agents are known in the art and can readily be used in the liquid toners and developers of the present invention. For example, particularly suitable charge control agents include the Pluronic series available from BASF, and particularly the PEO:PPO:PEO triblock copolymer charge control agent Pluronic F-108. Other charge control agents are disclosed, for example, in U.S. Pat. Nos. 5,866,292 and 5,688,624, the entire disclosures of which are incorporated herein by reference. In addition, aluminum di-tertiary butyl salicylate (ALOHAS) and similar compounds may also be used as the charge control agent. These latter materials can thus be used as either or both of the charge control agent and the charge director in the liquid toners and developers of the present invention.

After the ingredients are introduced into the vessel, with suitable particulate grinding media contained therein, the contents are mixed and ground for a suitable period of time to provide the desired particle size of solid material dispersed in the liquid carrier. In embodiments, the mixing is conducted, for example, for from about 0.5 to about 8 hours.

Preferably, mixing is conducted for from about 1 to about 6 hours, more preferably for from about 2 to about 5 hours, and most preferably about 4 hours. Of course, longer or shorter mixing times can be used depending, for example, upon the starting particle size of the solid material, the desired final particle size of the material, and the specific nature of the composition.

The cold grinding operation is preferably conducted at a temperature of from about 0 to about 50° C. When the grinding is to be conducted at temperatures below ambient (room) temperature, or when cooling is necessary to remove heat generated either by the mixing operation or by the mixer itself, such cooling can be achieved by any suitable means. For example, cooling can be achieved by circulating cold water or a cooling material through an external cooling jacket of the mixer, as is known to those skilled in the art.

In the mixing step, it is preferred that the particulate media be maintained in continuous or substantially continuous movement. Such movement creates shear and/or impact forces, causing a desired reduction in the particle size of the solid material. The solid material is ground so as to provide solid particles of the desired particle size. Preferably, the final average (by area) particle size of the solid material dispersed in the liquid carrier is less than 20 $\mu$m, and preferably less than 10 $\mu$m. More preferably, the average particle size of the solid material is from about 1 to about 10 $\mu$m, more preferably from about 2 to about 8 $\mu$m, and even more preferably from about 4 to about 6 $\mu$m.

Following the grinding operation, the solid particles, optionally with the liquid carrier, can be removed from the mixing apparatus and separated from the grinding media. If desired, particle size classification can be used to remove solid particles from the resultant dispersion that are larger and/or smaller than a desired size range.

If necessary, the concentration of the solid particles in the dispersion can be adjusted by addition or subtraction of liquid carrier. For example, the concentration can be reduced by the addition of additional amounts of the same or different non-polar liquid. The dilution can be conducted to reduce the concentration of solid particles in the liquid toner to between about 0.1 and about 5 percent by weight, preferably from about 0.5 to about 3 percent by weight, and more preferably from about 1 to about 2 percent by weight, with respect to the non-polar liquid.

A charge director is also preferably added to the dispersion to provide the final liquid toner or developer. Charge directors are preferably included in the liquid toner in any effective amount to initiate desired charging of the solid particles contained in the dispersion. In embodiments, the charge director is included in an amount of, for example, from about 0.001 to about 5 percent by weight, and preferably from about 0.005 to about 1 percent by weight, based on a total weight of solids contained in the liquid toner.

Suitable charge directors include any of the various charge directors known in the art for initiating the desired charging of the solid particles. General classes of charge directors include the aluminum salts of alkylated salicylic acid and the aluminum salts of alkylated salicylic acid. For example, suitable charge directors for use in the liquid toners of the present invention include, but are not limited to, alumninum di-tertiary-butyl salicylate (abbreviated Alohas) and similar compounds; hydroxy bis[3,5-tertiary butyl salicylic] aluminate; hydroxy bis[3,5-tertiary butyl salicylic] aluminate mono-, di-, tri- or tetrahydrates; hydroxy bis [salicylic] aluminate; hydroxy bis[monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate wherein alkyl preferably contains 1 to about 6 carbon atoms; bis[trialkylated hydroxy naphthoic acid] aluminate wherein alkyl preferably contains 1 to about 6 carbon atoms; bis[tetraalkylated hydroxy naphthoic acid] aluminate wherein alkyl preferably contains I to about 6 carbon atoms; EMPHOS PS-900™; mixtures thereof and the like. Other suitable charge directors are disclosed in U.S. Pat. Nos. 5,563,015 and 5,672,456, the entire disclosures of which are incorporated herein by reference. In embodiments of the present invention, the charge director is preferably Alohas alone, or a mixture of Alohas with EMPHOS PS-900™.

In other embodiments of the present invention, the charge director can be an inverse micelle, used to facilitate particle charging. The charge director can be comprised of quaternary ammonium salts, which are often polymeric in nature, conductive metal oxides, metal and organometallic salt, and the like. Suitable charge directors include, but are not limited to, those comprised of diblock or triblock copolymers of the formula A-B, BAB or A-B-A wherein the polar A block is an ammonium containing segment and B is a nonpolar block segment which, for example, provides for charge director solubility in the liquid ink fluid. Preferably, in such compounds, the A blocks have a number average molecular weight range of from about 200 to about 120,000; the B blocks have a number average molecular weight range of from about 2,000 to about 190,000; the ratio of Mw to Mn is 1 to about 5 for the copolymers; and the total number average molecular weight of the copolymer is, for example, from about 4,000 to about 300,000, and preferably about 100,000. Such materials are exemplified, for example, in U.S. Pat. No. 5,643,707, the entire disclosure of which is incorporated herein by reference.

Particularly preferred charge director compounds useful in the present invention are comprised of a protonated AB diblock copolymer selected from the group of poly(2-dimethylammonium ethyl methacrylate bromide co-2-ethylhexyl methacrylate), poly(2-dimethylammonium ethyl methacrylate tosylate co-2-ethylhexyl methacrylate), poly (2-dimethylan:monium ethyl methacrylate chloride co-2-ethylhexyl methacrylate) poly(2-dimethylammonium ethyl methacrylate bromide co-2-ethylhexyl acrylate), poly(2-dimethyla:monium ethyl acrylate bromide co-2-ethylhexyl methacrylate), poly(2-dimethylammonium ethyl acrylate bromide co-2-ethylhexyl acrylate), poly(2-dimethylammonium ethyl methacrylate tosylate co-2-ethylhexyl acrylate), poly(2-dimethylammonium ethyl acrylate tosylate co-2-ethylhexyl acrylate), poly(2-dimethylammonium ethyl methacrylate chloride co-2-ethylhexyl acrylate), and poly(2-dimethylammonium ethyl acrylate chloride co-2-ethylhexyl acrylate), poly(2-dimethylammonium ethyl methacrylate bromide co-N,N-dibutyl methacrylamide), poly(2-dimethylammonium ethyl methacrylate tosylate co-N,N-dibutyl methacrylamide), poly(2-dimethylammonium ethyl methacrylate bromide co-N,N-dibutylacrylamide), poly[2-dimethylammonium ethyl methacrylate tosylate co-N,N-dibutylacrylamide), and the like, and mixtures thereof.

As will be apparent to those of ordinary skill in the art, various other additives, known in the art, can be added to the liquid developer. Such additives can be used in their known amounts to provide known effects to the liquid developer.

As illustrated herein, the liquid inks, toners or developers of the present invention can be selected for imaging and printing methods wherein, for example, a latent image is formed on a photoconductive imaging member, such as disclosed in U.S. Pat. Nos. 4,265,990 and 5,414,498, the entire disclosures of which are incorporated herein by reference, followed by development with the liquid toner of the present invention by, for example, immersion of the imaging member in the liquid toner; transfer to a suitable substrate like paper; and fixing by heating.

Advantages of the present invention include the ability to provide low cost, high quality printing methods that include metallic colorants. The liquid toners and developers of the present invention, including the metallic colorants, provide metallic-appearing printed images that exhibit high printing quality. Furthermore, the present invention provides for metallic colored or appearing inks, which were not previously available in the field of ink jet inks, liquid toners and developers, and dry toners.

The following examples are illustrative of embodiments of the present invention, but are not limiting of the invention. It will be apparent, however, that the invention can be practiced with many different types and amounts of materials and can be used for a variety of different uses in accordance with the disclosure above and as pointed out hereinafter.

EXAMPLES

Example 1

A liquid toner is made with a metallic colorant, STAPA OFFSET 3000, aluminum particles having an average particle size of 7 microns, available from Obron-Atlantic, Painesville, Ohio. The liquid toner is prepared by adding 25 wt % metallic colorant, 1 wt % Alohas charge control agent, and the balance Nucrel 599 resin. The materials are added to a Union Process 01 Attritor with a sufficient amount of ISOPAR™ M liquid carrier to provide a dispersion of the resin/colorant particles in the liquid. The mixture is cold mixed and ground in the Attritor for about four hours to obtain dispersed particles having an average (by area) particle size of from about 2 to about 5 $\mu$m dispersed in the ISOPAR™ M liquid carrier. The dispersion is separated from the Attritor grinding media.

Following separation, an ink (liquid toner) is made from the dispersion by adding a suitable charge director, having a molecular weight of about 4,000, to initiate charging of the resin particles, and a further amount of ISOPAR™ L to obtain a final liquid toner having a solids content of about 1 percent by weight.

To evaluate the development properties of the liquid toner composition, the liquid toner composition is added to the sump of a Savin 870 liquid toner copier.

Documents are produced that indicate good image development, good transfer of the toner particles to the paper substrate, and good fusing of the metallic ink to the paper substrate.

As will be apparent to one of ordinary skill in the art, numerous changes, alterations and adjustments can be made to the above-described embodiments without departing from the scope of the invention, and the invention is in no way limited to the specific exemplary embodiments described above. One skilled in the art will recognize that the various aspects of the invention discussed above may be selected and adjusted as necessary to achieve specific results for a particular application. Furthermore, although the above discussion has focused upon liquid toners, the invention is in no way limited to liquid toners, and in fact is applicable in other similar development agents. Thus, the foregoing embodiments are intended to illustrate and not limit the present invention. It will be apparent that various modifications can be made without departing from the spirit and scope of the invention.

What is claimed is:

1. A liquid toner comprising:

a carrier liquid, and toner particles including a thermoplastic resin and a metallic colorant dispersed in said thermoplastic resin, said toner particles being dispersed in said carrier liquid.

2. The liquid toner of claim 1, further comprising a charge control agent.

3. The liquid toner of claim 1, wherein the liquid carrier comprises a non-polar liquid.

4. The liquid toner of claim 1, wherein the metallic colorant has an average particle size of less than about 10 microns.

5. The liquid toner of claim 1, wherein the metallic colorant has an average particle size of from about 1 micron to about 10 microns.

6. The liquid toner of claim 1, wherein the metallic colorant comprises a material selected from the group consisting of elemental metals, metal alloys; metal compounds, and mixtures thereof.

7. The liquid toner of claim 1, wherein the metallic colorant is selected from the group consisting of aluminum, silver, gold, copper, iron, steel, titanium, brass, bronze, and mixtures thereof.

8. The liquid toner of claim 1, wherein the metallic colorant is an elemental metal or a metal alloy.

9. The liquid toner of claim 1, wherein the metallic colorant has a shape selected from the group consisting of spherical particles, flakes, slivers, and rods.

10. The liquid toner of claim 1, wherein the metallic colorant is present in the toner particles in an amount of from about 5 percent to about 50 percent by weight of the toner particles.

11. The liquid toner of claim 1, wherein the metallic colorant comprises metallic particles covered by an insulating material.

12. The liquid toner of claim 1, further comprising a non-metallic colorant.

13. The liquid toner of claim 12, wherein the non-metallic colorant is selected from the group consisting of one or more pigments, one or more dyes, and mixtures of one or more dyes and one or more pigments.

14. The liquid toner of claim 12, wherein the non-metallic colorant is a fluorescent colorant.

15. The liquid toner of claim 1, further comprising second toner particles comprising a thermoplastic resin and a non-metallic colorant dispersed in said thermoplastic resin.

16. The liquid toner of claim 15, wherein said second toner particles do not include said metallic colorant.

17. The liquid toner of claim 1, wherein said liquid carrier has a viscosity of from about 0.5 to about 500 cP at 25° C., an electrical volume resistance of greater than $1\times10^9$ Ω-cm, and a dielectric constant of less than about 3.0.

18. The liquid toner of claim 1, wherein said liquid carrier has a viscosity of from about 1 to about 20 cP at 25° C. and an electrical volume resistance of greater than $5\times10^9$ Ω-cm.

19. The liquid toner of claim 1, wherein said liquid carrier comprises a branched-chain aliphatic hydrocarbon.

20. The liquid toner of claim 1, wherein the toner resin comprises a thermoplastic resin.

21. The liquid toner of claim 1, wherein the metallic colorant provides a metallic appearance to said toner particles.

22. A method for producing the liquid toner composition of claim 1, comprising:

mixing said metallic colorant and said thermoplastic resin to homogeneously disperse the metallic colorant in the thermoplastic resin to form a colorant/resin mixture;

mixing the colorant/resin mixture with said carrier liquid to form a dispersion; and grinding the dispersion to form toner particles of the colorant/resin mixture dispersed in said carrier liquid, wherein the toner particles have an average particle size of less than about 20 $\mu$m.

23. A method of developing an image, comprising:

forming an electrostatic latent image;

developing said electrostatic latent image with the liquid toner of claim 1 to form a developed image;

transferring said developed image to a receiving substrate;

and fixing said developed image to said receiving substrate, wherein said fixed and developed image has a metallic sheen.

* * * * *